US006854502B2

(12) United States Patent
Lai

(10) Patent No.: US 6,854,502 B2
(45) Date of Patent: Feb. 15, 2005

(54) MULTI-FUNCTIONAL SHADING DEVICE

(76) Inventor: Tony Lai, 2328 N. Durfee Ave., El Monte, CA (US) 91732

( * ) Notice: Subject to any disclaimer, the term of this patent is extended or adjusted under 35 U.S.C. 154(b) by 0 days.

(21) Appl. No.: 10/237,236

(22) Filed: Sep. 9, 2002

(65) Prior Publication Data

US 2002/0195210 A1 Dec. 26, 2002

Related U.S. Application Data

(62) Division of application No. 09/810,814, filed on Mar. 16, 2001, now Pat. No. 6,516,856.

(51) Int. Cl.[7] ..... E06B 3/32
(52) U.S. Cl. ..... 160/89; 160/84.03
(58) Field of Search ..... 160/89, 115, 84.03, 160/167 R, 84.01, 84.04, 168.1 R, 84.06

(56) References Cited

U.S. PATENT DOCUMENTS 4,733,711 A * 3/1988 Schon ..... 160/84.03
4,799,524 A * 1/1989 Guermonprez ..... 160/84.03
4,813,468 A * 3/1989 Fraser ..... 160/84.03
4,953,610 A * 9/1990 Phillips et al. ..... 160/84.03
5,121,783 A * 6/1992 Nilsson ..... 160/89
5,791,390 A * 8/1998 Watanabe ..... 160/84.03
6,276,425 B1 * 8/2001 Mausar et al. ..... 160/84.03
6,516,856 B2 * 2/2003 Lai ..... 160/89

* cited by examiner

*Primary Examiner*—David Purol
(74) *Attorney, Agent, or Firm*—David and Raymond Patent Group; Raymond Y. Chan

(57) ABSTRACT

A multi-functional shading device includes a first shading arrangement including a top traverse supporter adapted for affixing to a top beam of a ceiling, a first shading arrangement downwardly extended from the top traverse supporter including a base member and a first operating device for selectively lifting up the base member towards the traverse supporter and unlifting the base member to drop downwardly away from the traverse supporter, and a second shading arrangement including a base stabilizer, a translucent fabric, which is folded in a Z-shaped manner, downwardly extended from the base member to the base stabilizer, and a second operating device for folding and unfolding the translucent fabric. Therefore, the first and second shading arrangements having different light intensity blocking abilities are adapted for selectively blocking lights passing through from one side to another side of the shading arrangements respectively.

12 Claims, 17 Drawing Sheets

MULTI-FUNCTIONAL SHADING DEVICE

CROSS REFERENCE OF RELATED APPLICATION

This is a divisional application a non-provisional application, application Ser. No. 09/810,814, filed Mar. 16, 2001 now U.S. Pat. No. 6,516,856.

BACKGROUND OF THE PRESENT INVENTION

1. Field of Invention

The present invention relates to window curtains, and more particularly to a multi-functional shading device which is adapted for selectively shading the intensity of sunlight.

2. Description of Related Arts

Curtains and the like such as drapes and portieres are common used for sheltering window, separating spaces, and etc since they are easy to open and close, and aesthetically appealing. Most of the curtains comprise a traverse supporter adapted to affix to a ceiling, a slider track mounted on a bottom of the traverse supporter, and a plurality of slats horizontally and suspendedly mounted by hanging strings respectively in such a manner by operating a pulley system, the slats are slid in a vertical movable manner, or individually rotated at the same time.

However, the curtain has several drawbacks. When the curtain is opened, an excessive amount of sunlight can directly be admitted into the house in which the sunlight not only can heat up the house but also is unpleasing to people's eye. On the other hand, when the curtain is fully closed, it is capable of blocking all the sunlight effectively. People may alternatively need to turn on the light lamp in order to brighten up the house. Furthermore, people has not privacy at all since when the curtain is opened, an interior of the house is easily viewed from outside so that people may merely close the curtain for privacy and security or open the curtain for enjoying the sunlight.

Therefore, drapery is an alternative method that people is used for window curtain. The drapery usually made of woven which is lightweight provides decorative effects. The drapery also provides privacy for people because the drapery is semi-transparent that people from outside are vague to see through the interior of the house. Moreover, the drapery can partially block the sunlight so as to soften the sunlight. However, since the drapery is soft and light weight, the wind can cause it to sway which may create disturbing light effects and even has an embarrassment of "flying" drapery.

SUMMARY OF THE PRESENT INVENTION

A main object of the present invention is to provide a multi-functional shading device which comprises a blind section and a translucent fabric section so as to selectively shade the intensity of sunlight.

Another object of the present invention is to provide a multi-functional shading device wherein the blind section and the translucent fabric section are operating individually so as to prevent the sections from being interfered with each other.

Another object of the present invention is to provide a multi-functional shading device which is facilitated to be installed to a ceiling.

Another object of the present invention is to provide a multi-function shading device which can achieve all features of conventional curtains such as easy operation, less expensive, adapted to soften the sunlight, keep personal privacy, and providing an aesthetically appealing. In other words, the present invention is an all-in window curtain.

Accordingly, in order to accomplish the above objects, the present invention provides a multi-functional shading device, which comprises:

a top traverse supporter adapted for affixing to a top beam of a ceiling;

a first shading arrangement downwardly extended from the top traverse supporter comprising a base member and a first operating means for selectively lifting up the base member towards the traverse supporter and unlifting the base member to drop downwardly away from the traverse supporter; and a second shading arrangement comprising a base stabilizer, a translucent fabric, which is folded in a Z-shaped manner, downwardly extended from the base member to the base stabilizer, and a second operating means for folding and unfolding the translucent fabric, wherein the first and second shading arrangements having different light intensity blocking abilities are adapted for selectively blocking lights passing through from one side to another side of the shading arrangements respectively.

DETAILED DESCRIPTION OF THE PREFERRED EMBODIMENT

Figure 1:
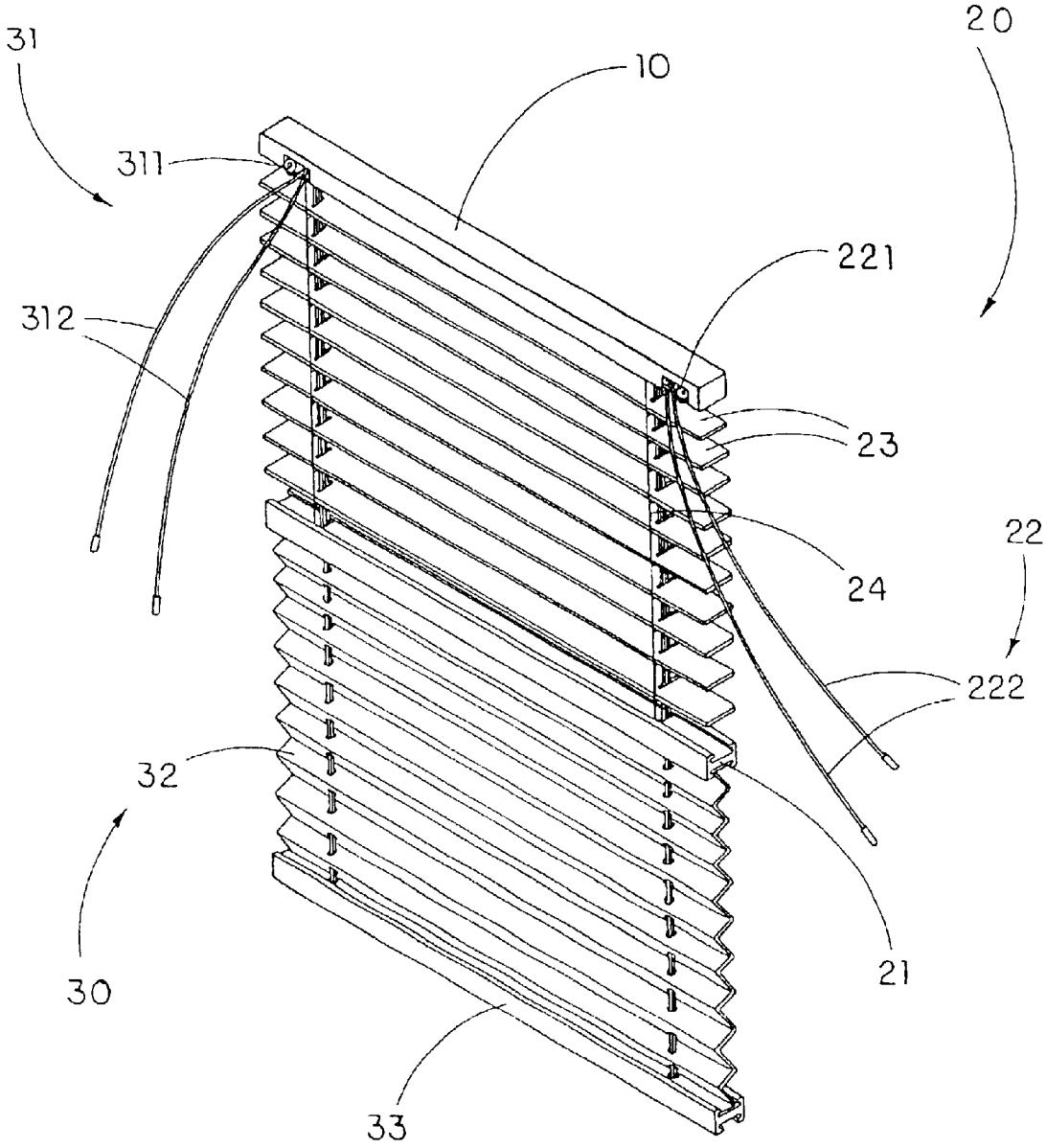
FIG. 1 is a perspective view of a multi-functional shading device according to a first preferred embodiment of the present invention.

Referring to FIG. 1 of the drawings, a multi-functional shading device according to a first preferred embodiment of the present invention is illustrated, wherein the multi-functional shading device is adapted for mounting on a window frame so as to selectively blocking the sunlight from outside.

The multi-functional shading device comprises a top traverse supporter 10 adapted for affixing to a top beam C of a window, a first shading arrangement 20, and a second arrangement 30 wherein the first shading arrangement 20 and the second shading arrangement 30 having different light intensity blocking abilities are adapted for selectively blocking the light passing through from one side to another side of the multi-functional shading device.

The first shading arrangement 20 is downwardly extended from the top traverse supporter 10 wherein the first shading arrangement 20 comprises a base member 21 provided at a bottom portion thereof and a first operating means 22 for selectively lifting up the base member 21 towards the traverse supporter 10 and unlifting the base member 21 to drop downwardly away from the traverse supporter 10.

The first shading arrangement 20 preferably is a slat-type curtain, which comprises a plurality of slats 23, and a blind supporting system 24 for spacedly and suspendedly supporting the slats 23 horizontally between the traverse supporter 10 and the base member 21 and controlling a tilt angle of each of the slats 23.

Figure 2:
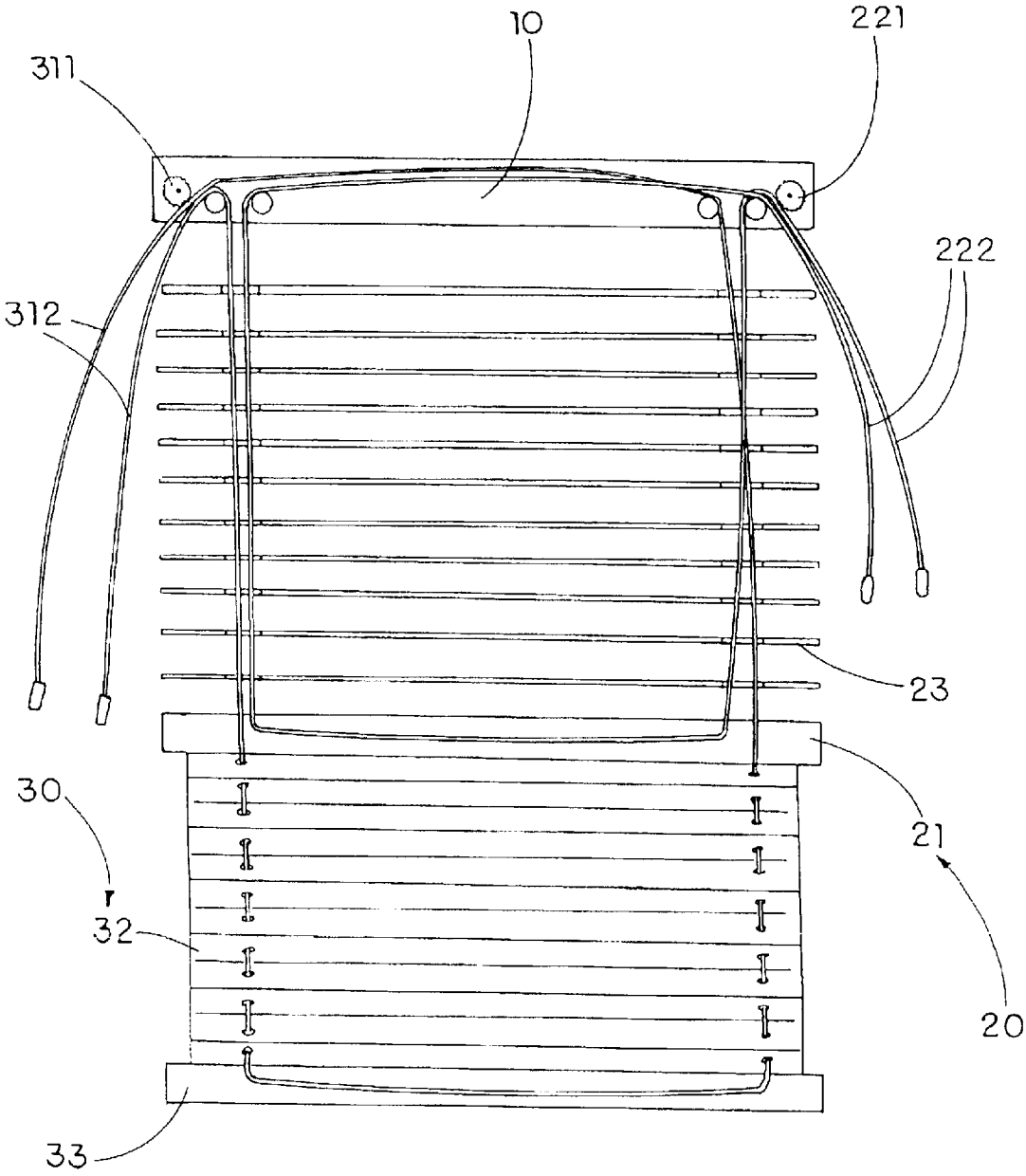
FIG. 2 is a schematic view of the multi-functional shading device according to the first preferred embodiment of the present invention.

The first operating means 22 comprises a first lift lock 221 rotatably mounted on the traverse supporter 10 and a pair of lift cords 222 each having a first end portion extended to the bottom member 21. Each of the two lift cords 222 upwardly extends to penetrate through the slats 23 and then traversely extends through the traverse supporter 10, wherein a second end portion of each of the lift cords 222 is extended out of the traverse supporter 10 via the first lift lock 221 to control the folding and unfolding of the first shading arrangement 20. Accordingly, the lift cords 221 can integrally form in one piece member wherein the first end portions of the lift cords 221 are integrally connected together along the base member 21 so as to enhance the folding and unfolding operations of the first shading arrangement 20, as shown in FIG. 2.

The second shading arrangement 30, which is downwardly extended from the base member 21 of the first shading arrangement 20, comprises a second operating means 31 for folding and unfolding the second shading arrangement 20.

The second shading arrangement 30 comprises a base stabilizer 33 and a translucent fabric 32, which is folded in a Z-shaped manner, extended between the base stabilizer 33 and the base member 21 of the first shading arrangement 20.

The translucent fabric 32 is preferably made of woven which is adapted for partially blocking the light so as to soften the light. The base stabilizer 33 is adapted for providing a weight of the translucent fabric 32. Since the translucent fabric 33 is soft and light weight, the wind can cause it to sway which may create disturbing light effects and even has an embarrassment of "flying" fabric. So, the base stabilizer 33 is adapted for reinforcing the shape of the translucent fabric 33 so as to enhance the folding operation of the second shading arrangement 30.

The second operating means 31 comprises a second lift lock 311 rotatably mounted on the traverse supporter 10 and a pair of lift cords 312 upwardly extending to penetrate through the translucent fabric 32 and the first shading arrangement 20 and then traversely extending through the traverse supporter 10, as shown in FIG. 2. Each of the lift cords 312 has a first end portion extended to the base stabilizer 33 and a second end portion extended out of the traverse supporter 10 via the second lift lock 311 for lifting up the base stabilizer 33 towards the base member 21 and unlifting the base stabilizer 33 to drop downwardly away from the base member 21, so as to fold and unfold the translucent fabric 32 respectively. Accordingly, the lift cords 312 can integrally form in one piece member wherein the first end portions of the lift cords 312 are integrally connected together along the base stabilizer 33 so as to enhance the folding and unfolding operations of the second shading arrangement 30.

The multi-functional shading device further comprises a connecting means 40 for connecting the first and second shading arrangements 20, 30 wherein the connecting means 40 comprises a top connecting member 41, which is a U-shaped mounting slot 411, provided on a bottom surface of the base member 21 for securely receiving a top portion of the translucent fabric 32, and a bottom connecting member 42, which also is a U-shaped mounting slot 421, provided on a top surface of the base stabilizer 33 for securely receiving a bottom portion of the translucent fabric 32, so as to securely connect the translucent fabric 32 between the base member 21 and the base stabilizer 33.

Figure 3B:
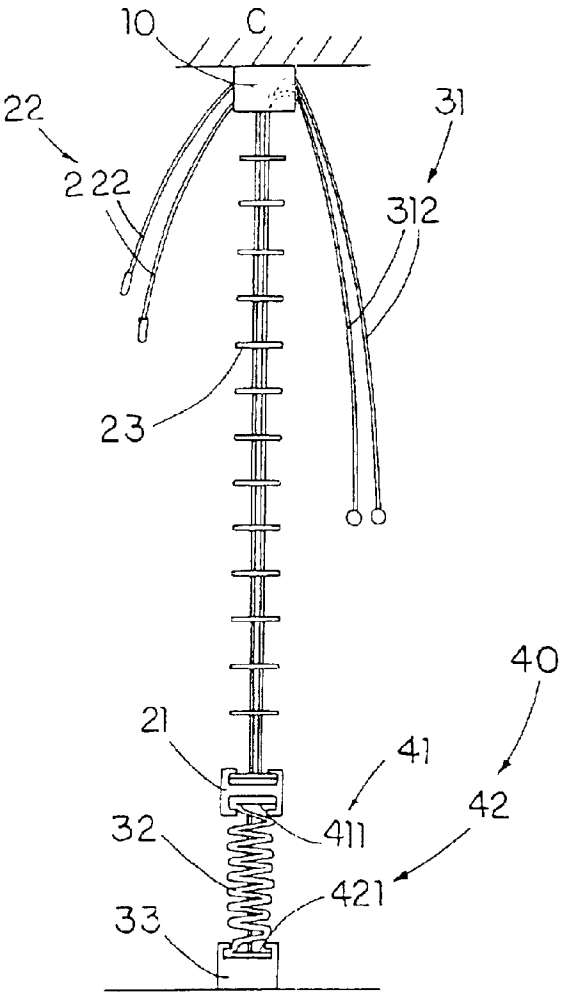
FIGS. 3A to 3D illustrate an operation of the multi-functional shading device according to the above first preferred embodiment of the present invention.
Figure 3A:
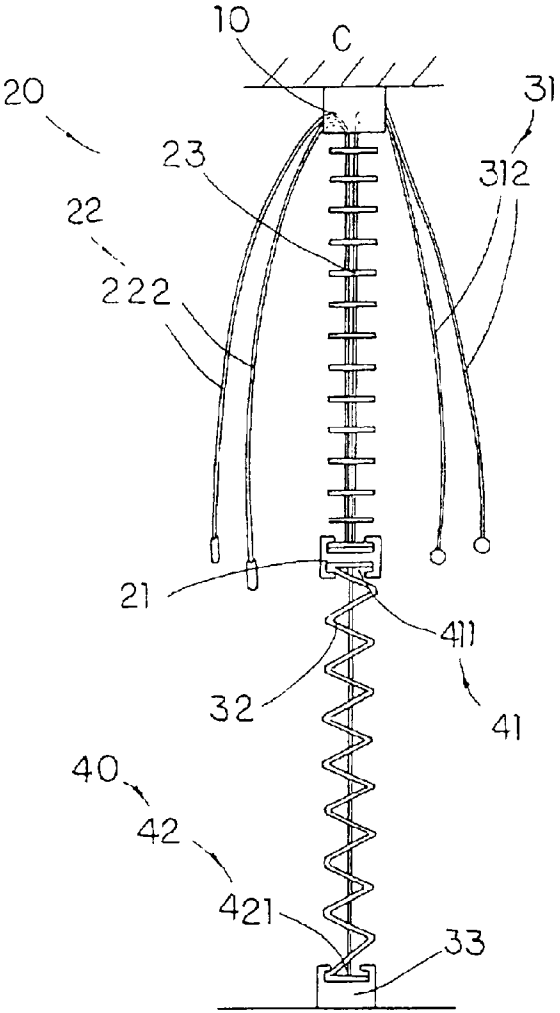
Figure 3C:
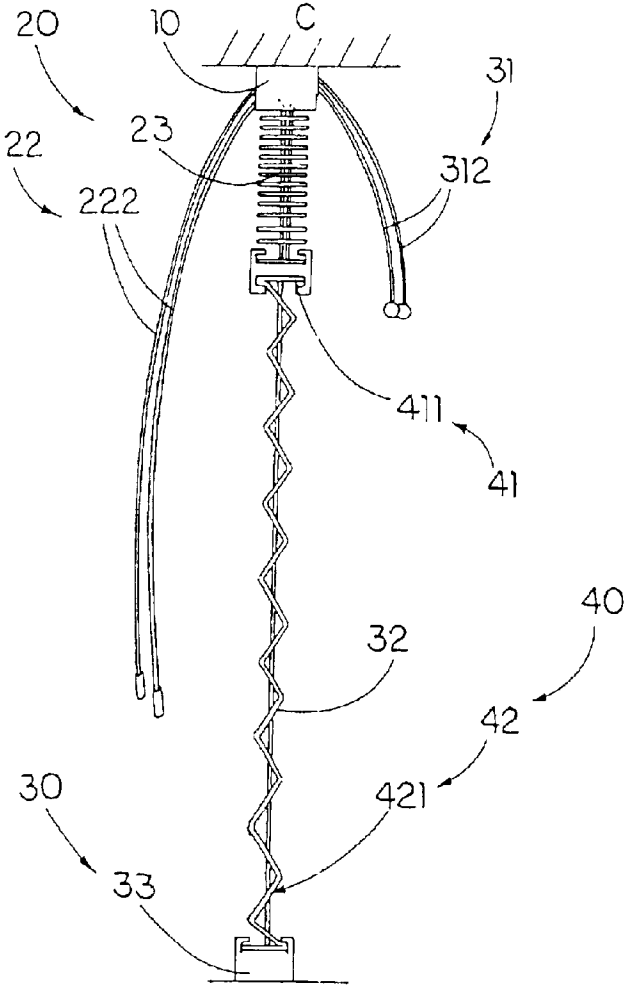
Figure 3D:
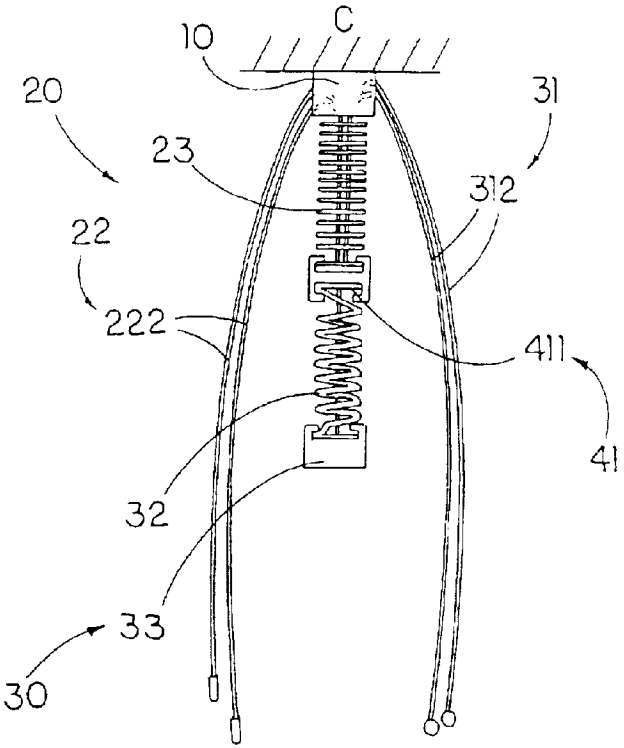

As shown in FIGS. 3A through 3D, the multi-functional shading device is capable of providing various shading areas for the user. As shown in FIG. 3A, the first and second shading arrangements 20, 30 are partially unfolded in such a manner that the light from outside is partially divided into an upper portion and a lower portion wherein the upper portion of the light is selectively blocked by the first shading arrangement 20 and the lower portion of the light is selectively blocked by the second shading arrangement 30. Also, the user is able to fully unfold either the first shading arrangement 20 or the second shading arrangement 30 as shown in FIGS. 3B and 3C, such that the multi-functional shading device is formed as a conventional slat type curtain or drapery type curtain respectively. As shown in FIG. 3D, the first and second shading arrangements 20, 30 are adapted to be folded up so that maximum light can pass through the window directly without any blockage by the multi-functional shading device.

It is worth to mention that the first operating means 22 and the second operating means 31 are arranged to operate the first shading arrangement 20 and the second shading arrangement 30 individually so as to prevent the first and second shading arrangements 20, 30 from being interfered with each other. In other words, the first and second shading arrangements 20, 30 are adapted for selectively folding and unfolding individually so as to selectively block the intensity of the light.

Figure 4:
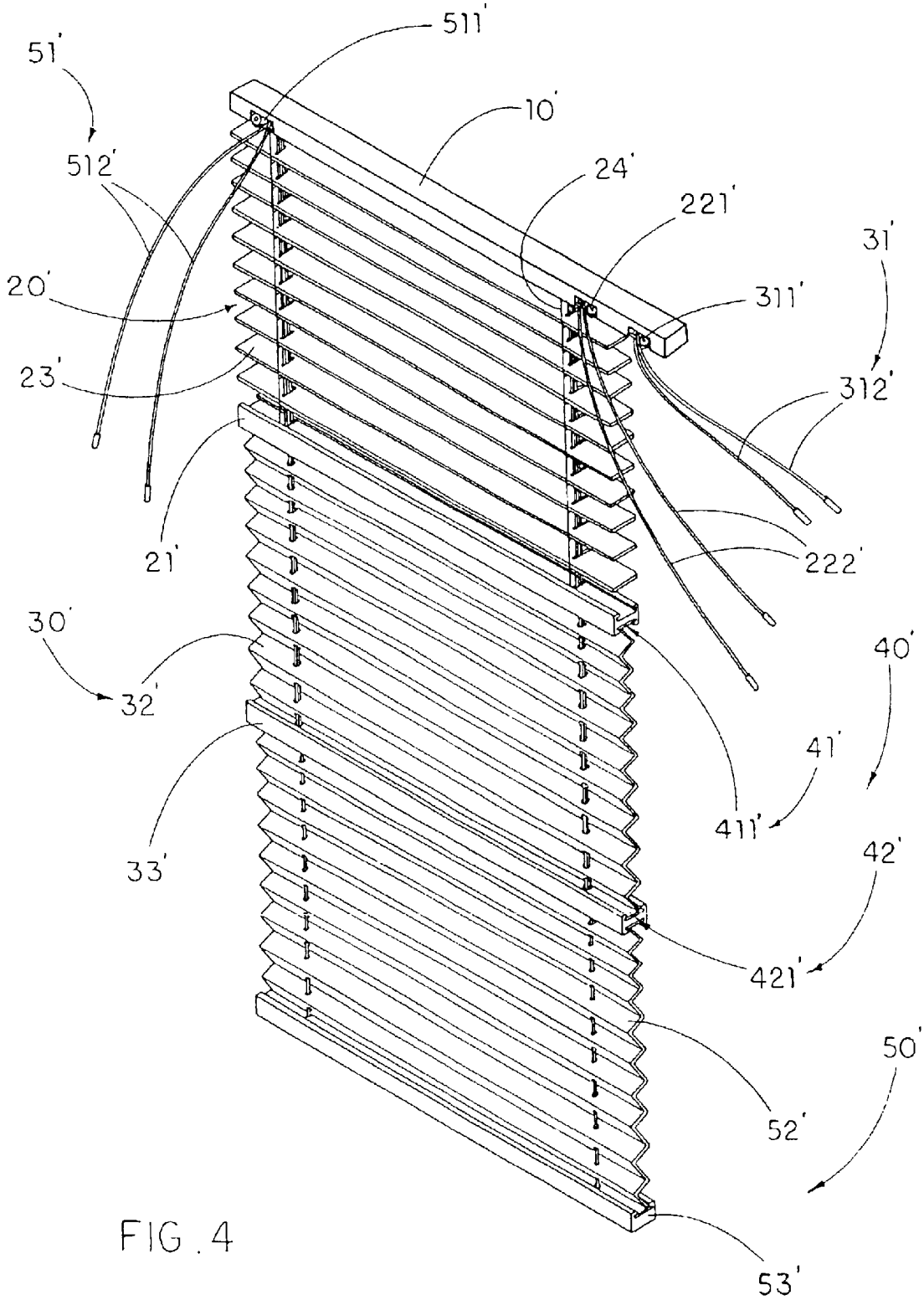
FIG. 4 is a perspective view of a multi-functional shading device according to a second preferred embodiment of the present invention.

Referring to FIG. 4, a multi-functional shading device according to a second embodiment of the present invention is illustrated, wherein the second embodiment basically is a modification of the first above embodiment, which further comprises a third shading arrangement 50' downwardly extended from the second shading arrangement 30'.

The third shading arrangement 50' comprises a supplementary base stabilizer 53', a supplementary translucent fabric 52', which is folded in a Z-shaped manner, extended between the supplementary base stabilizer 53' and the base stabilizer 33' of the second shading arrangement 30', and a third operating means 51' for lifting up the supplementary base stabilizer 53' towards the base stabilizer 33' and unlifting the supplementary base stabilizer 53' to drop down away from the base stabilizer 33' of the second shading arrangement 30'.

The supplementary translucent fabric 52' is made of translucent material which is different from that of the translucent fabric 32' of the second shading arrangement 30' in such a manner that the translucent fabric 32' of the second shading arrangement 30' and the supplementary translucent fabric 52' of the third shading arrangement 50' are adapted for blocking different intensities of light respectively.

Figure 5:
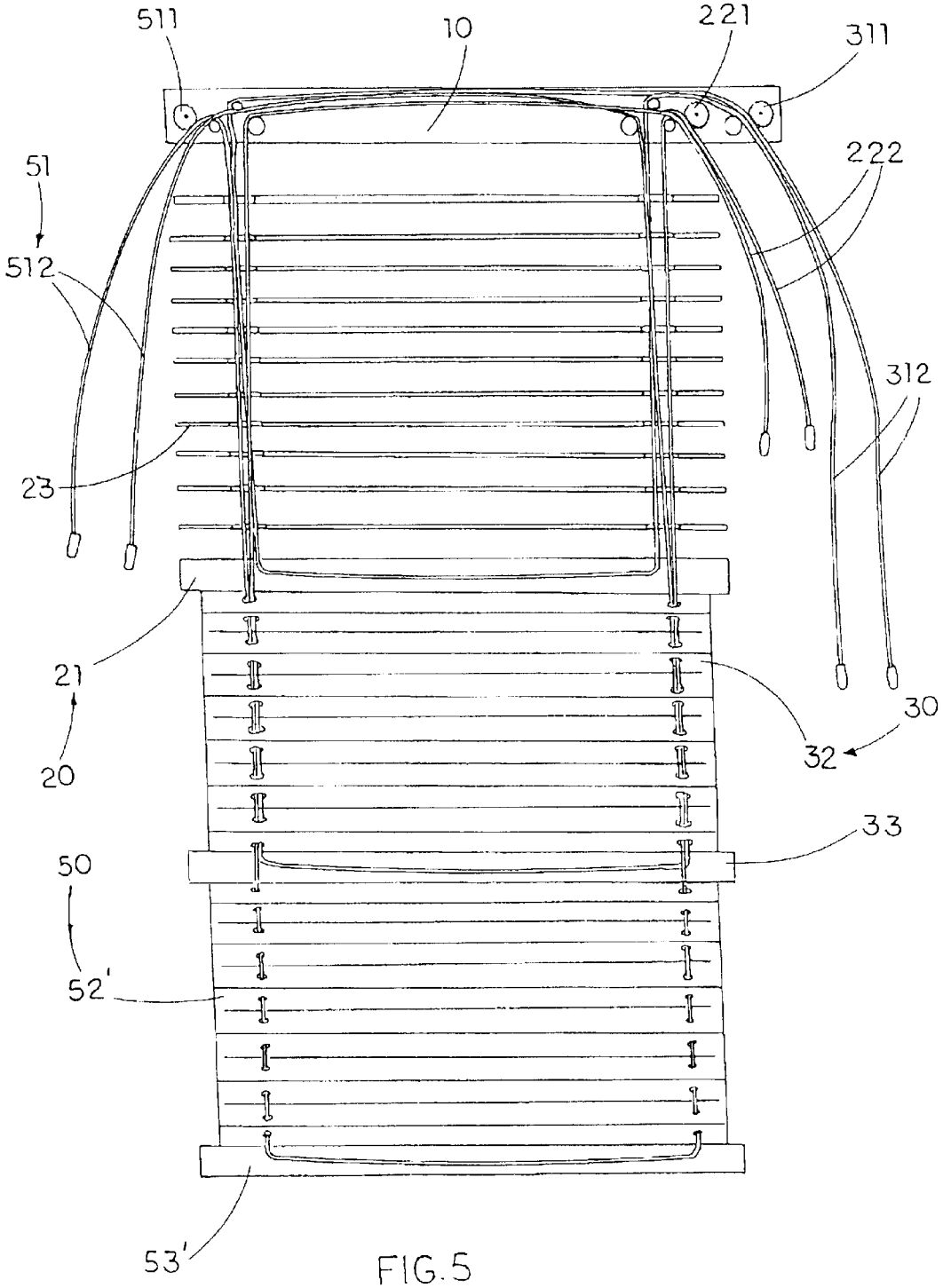
FIG. 5 is a schematic view of the multi-functional shading device according to the above second preferred embodiment of the present invention.

As shown in FIG. 5, the third operating means 51' comprises a third lift lock 511' rotatably mounted on the traverse supporter 10' and a pair of lift strings 512' upwardly extending to penetrate through the supplementary translucent fabric 52' and the second and first shading arrangements 30', 20' respectively, and then traversely extending through the traverse supporter 10', as shown in FIG. 5. Each of the lift strings 512 has a first end portion extended to the supplementary base stabilizer 53' and a second end portion extended out of the traverse supporter 10' via the third lift lock 511 for lifting up the supplementary base stabilizer 53' towards the base stabilizer 33' and unlifting the supplementary base stabilizer 53' to drop downwardly away from the base stabilizer 33', so as to fold and unfold the supplementary translucent fabric 52' respectively.

In addition, the top connecting member 41' of the connecting means 40', which is a U-shaped mounting slot 411', also provided on a bottom surface of the base stabilizer 33' for securely receiving a top portion of the supplementary translucent fabric 52', and the bottom connecting member 42', which also is a U-shaped mounting slot 421', also provided on a top surface of the supplementary base stabilizer 53' for securely receiving a bottom portion of the supplementary translucent fabric 52', so as to securely connect the supplementary translucent fabric 52' between the base stabilizer 33' and the supplementary base stabilizer 53'.

Accordingly, the multi-functional shading device of the second embodiment is adapted for selectively blocking the intensity of light with respect to the first, second, and third shading arrangements 20', 30', 50'. The first, second, and third shading arrangements 20', 30', 50' are capable of selectively folding and unfolding individually via the first, second, and third operating means 22', 31', 51' respectively, similarly as mentioned in the above first embodiment in FIG. 3, so as to obtain an optimum shading area of the multi-functional shading device.

Figure 6:
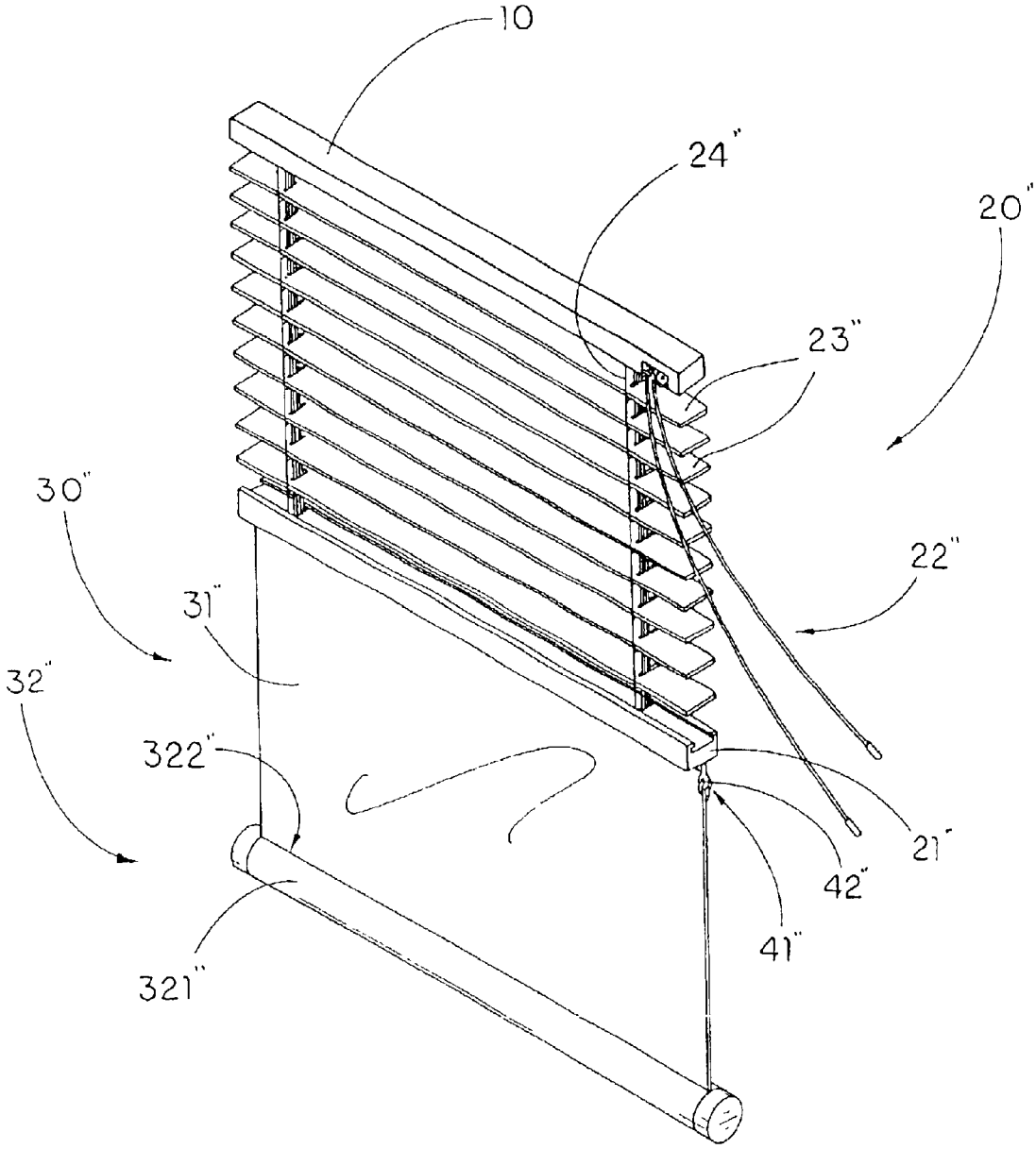
FIG. 6 is a perspective view of a multi-functional shading device according to a third preferred embodiment of the present invention.
Figure 7B:
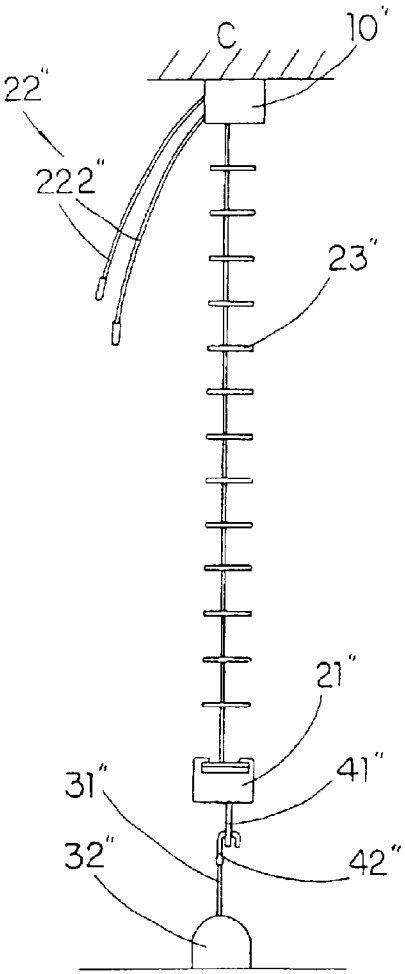
FIGS. 7A to 7D are partially perspective views of the multi-functional shading device according to the above third preferred embodiment of the present invention.
Figure 7A:
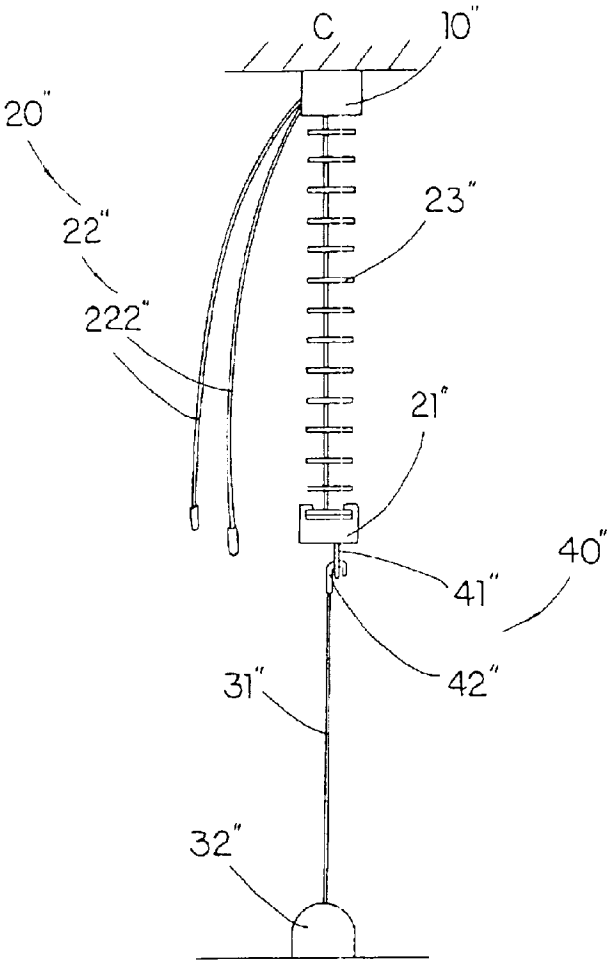
Figure 7D:
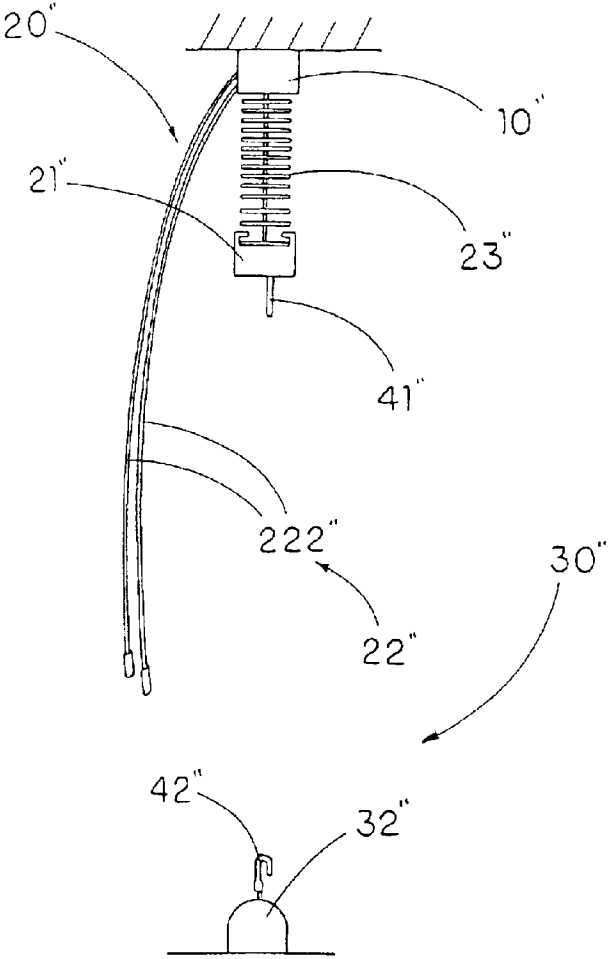
Figure 7C:
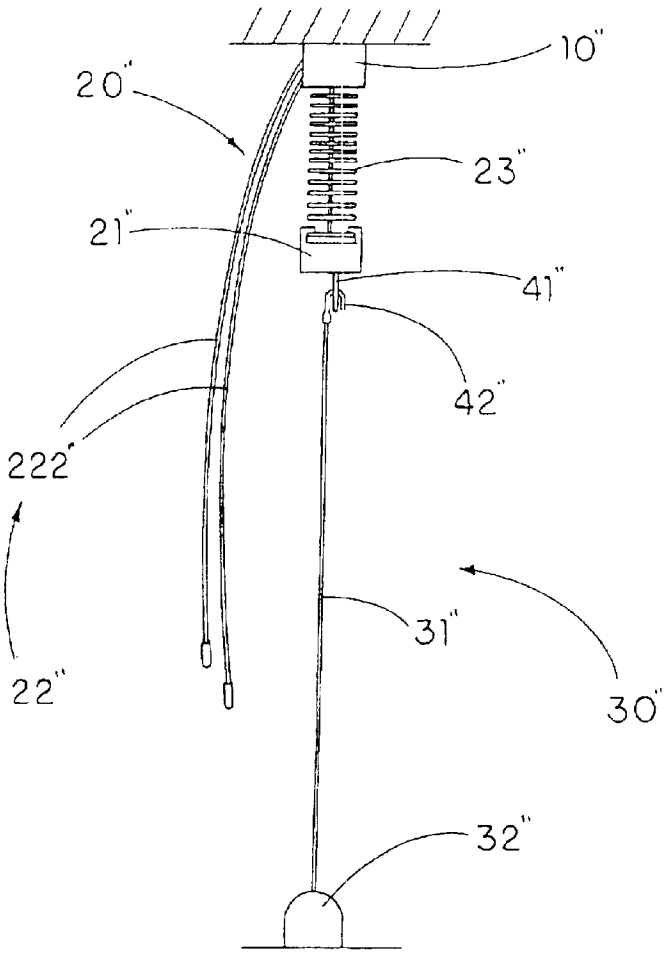

Referring to FIG. 6, a multi-functional shading device according to a third preferred embodiment of the present invention is illustrated, which is adapted for incorporating with an existing slat type curtain.

As shown in FIG. 6, a first shading arrangement 20" is an existing slat type curtain comprising a base member 21", a first operating means 22", a plurality of slats 23" and a blind supporting system 24" as mentioned in the above first embodiment, wherein a second shading arrangement 30" is adapted for detachably attaching to the base member 21".

The second shading arrangement 30" comprises a flat of translucent fabric 31" and a second operating means 32' for folding and unfolding the translucent fabric 31". The operating means 32" comprises a spring powered receiving device 321" having a slit 322" traversely formed thereon wherein a bottom edge of the translucent fabric 31" is affixed to the receiving device 321" in such a manner that the entire translucent fabric 31" is adapted for automatically receiving into the receiving device 321" through the slit 322" in a rolling manner, so as to fold up the second shading arrangement 30".

As shown in FIG. 7, the connecting means 40" comprises a top connecting member 41" provided on a bottom surface of the base member 21" of the first shading arrangement 20" and a bottom connecting member 42" provided on a top edge of the translucent fabric 31" in such a manner that the top connecting member 41" is adapted for detachably connecting to the bottom connecting member 42" so as to detachably attach the second shading arrangement 30" to the first shading arrangement 20". Accordingly, the top connecting member 41" is a pair of engaging rings 411" affixed to two ends of the base member 21" of the first shading arrangement 20" and the bottom connecting member 42" is a pair of engaging hooks 421" affixed to two top edge ends of the translucent fabric 31" for hooking on the two engaging rings 411" respectively.

Figure 8:
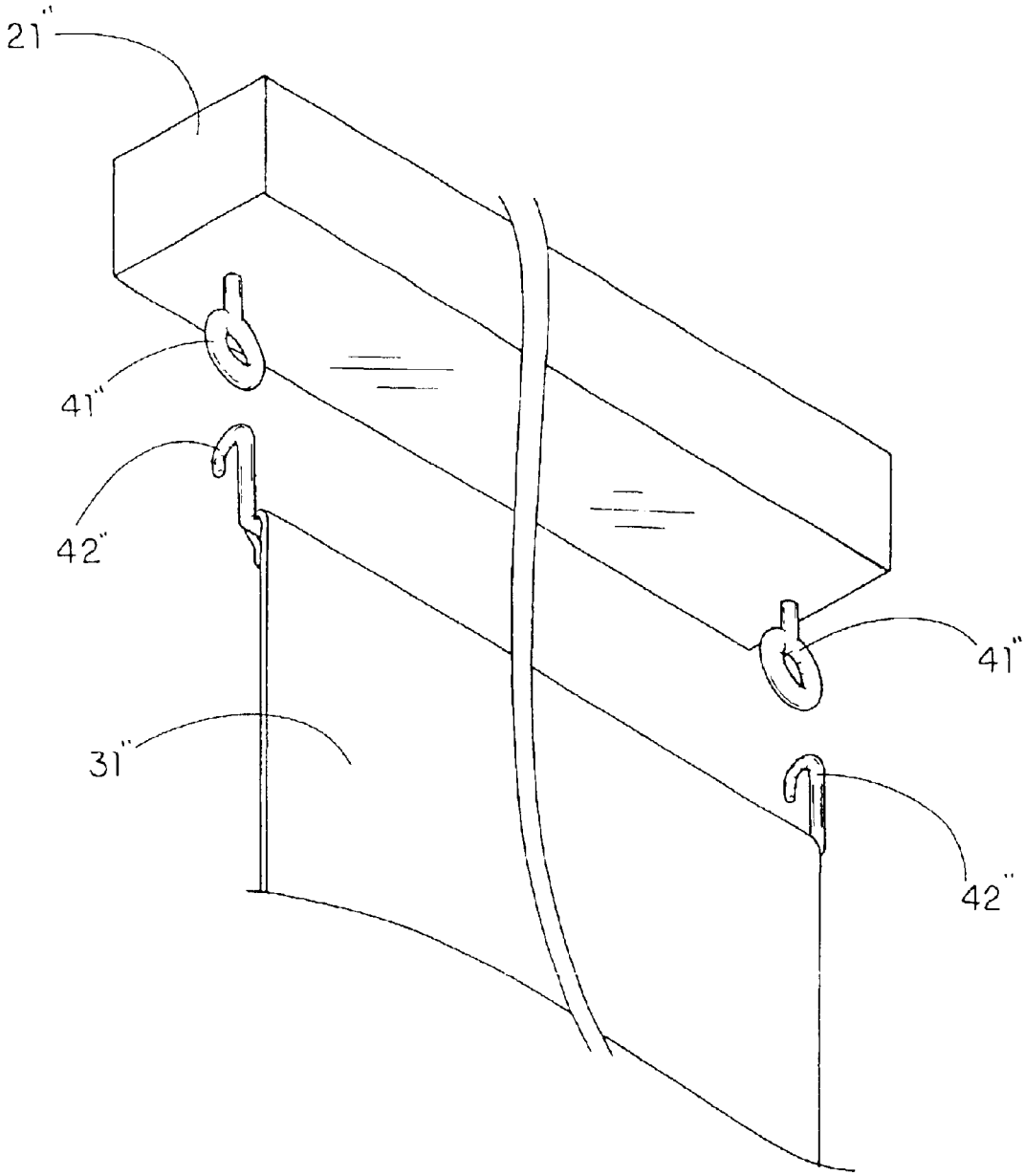
FIG. 8 illustrates an operation of the multi-functional shading device according to the above third preferred embodiment of the present invention.

For attaching the second shading arrangement 30" to the first shading arrangement 20', the translucent fabric 31" is pull out of the receiving device 321" and then hook the top edge of the translucent fabric 31" to the base member 21". When folding up the translucent fabric 31", simply detach the translucent fabric 31" from the base member 21", and then the receiving device 321" will automatically roll up and receive the translucent fabric 31" in the receiving device 321", as shown in FIG. 8.

Figure 9:
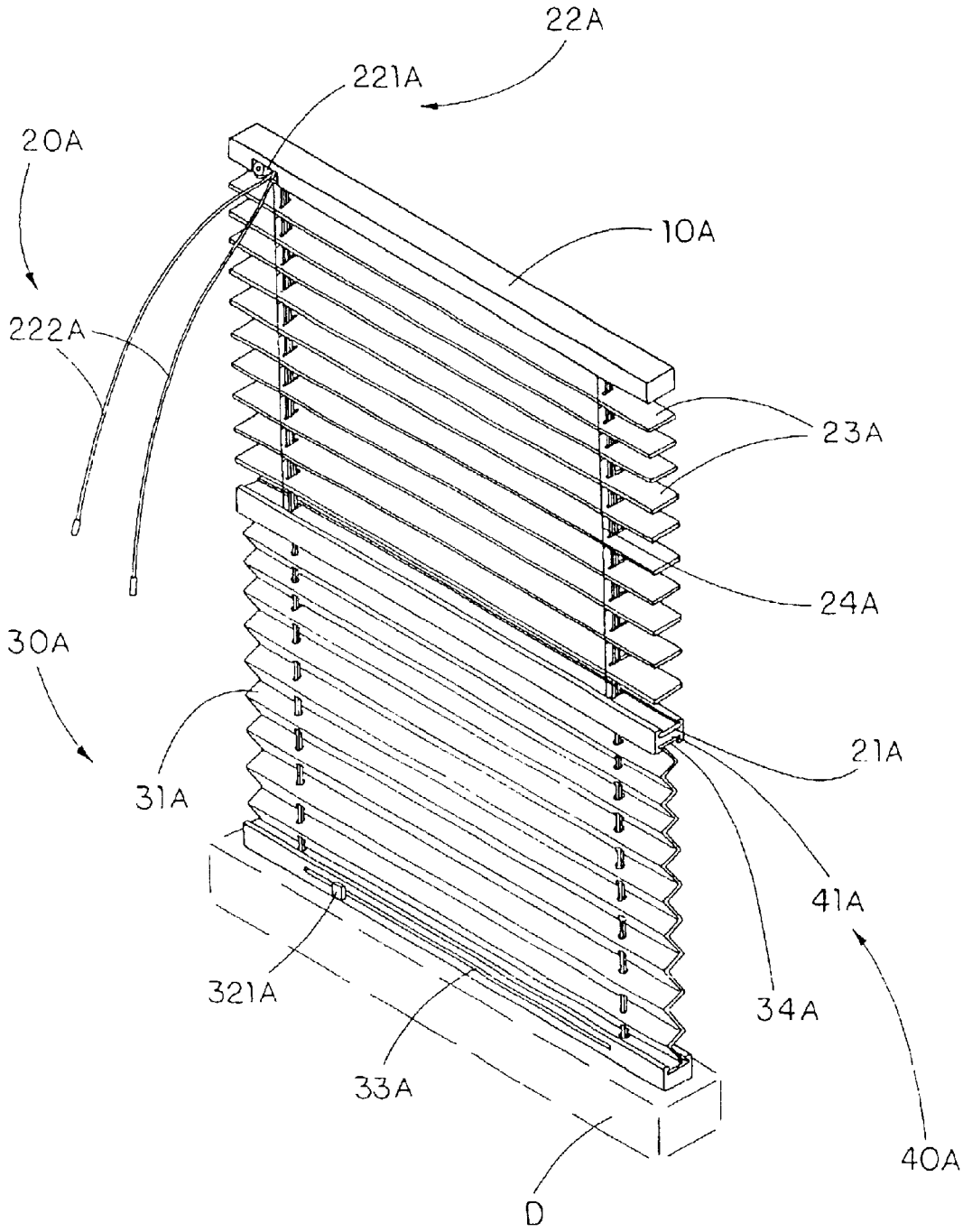
FIG. 9 is a perspective view of a multi-functional shading device according to a fourth preferred embodiment of the present invention.

Referring to FIG. 9, a fourth embodiment of the present invention illustrates an alternative mode of the above third embodiment, which is adapted for mounting on the existing slat type curtain.

As shown in FIG. 9, a first shading arrangement 20A is an existing slat type curtain comprises a base member 21A, a first operating means 22A, a plurality of slats 23A, and a blind supporting system 24A as mentioned above, wherein the second shading arrangement 30A is adapted for detachably mounting on the base member 21A of the first shading arrangement 20A.

The second shading arrangement 30A comprises an upper supporter 34A, a base stabilizer 33A adapted for detachably attaching on a bottom beam D of the window, a translucent fabric 31A foldably extended between the upper supporter 34A and the base stabilizer 33A, and a second operating means 32A for folding and unfolding the translucent fabric 31A.

Figure 10:
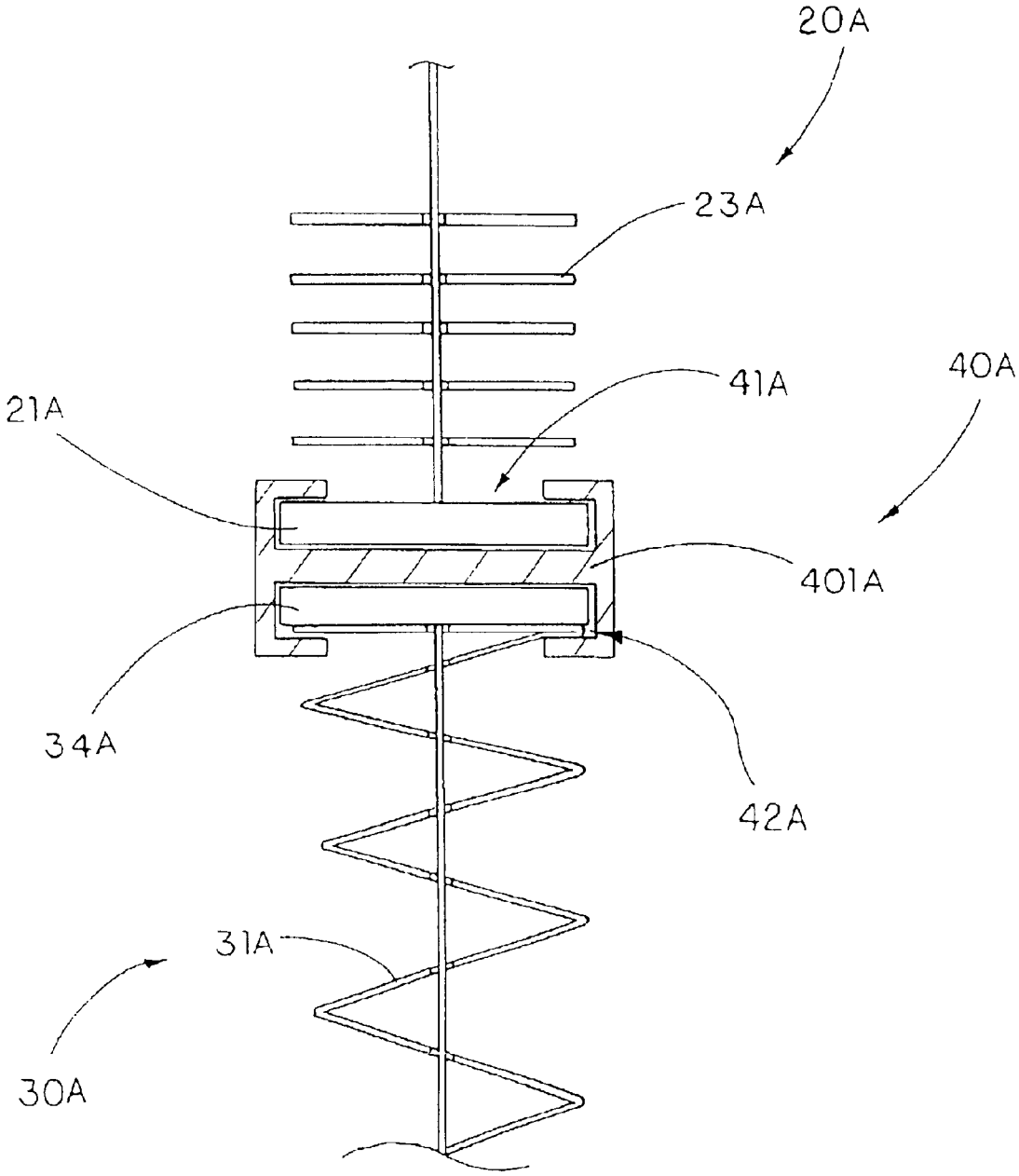
FIG. 10 is a partially side view of the multi-functional shading device according to the above fourth preferred embodiment of the present invention.

The connecting means 40A comprises a H-shaped connecting member 401A having a top mounting slot 41A and a bottom mounting slot 42A wherein the base member 21A of the first shading arrangement 20A is slidably inserted into the top mounting slot 41A and the upper supporter 34A of the second shading arrangement 30A is slidably inserted into the bottom mounting slot 42A, so as to securely connect the second shading arrangement 30A to the first shading arrangement 20A, as shown in FIG. 10.

Figure 11:
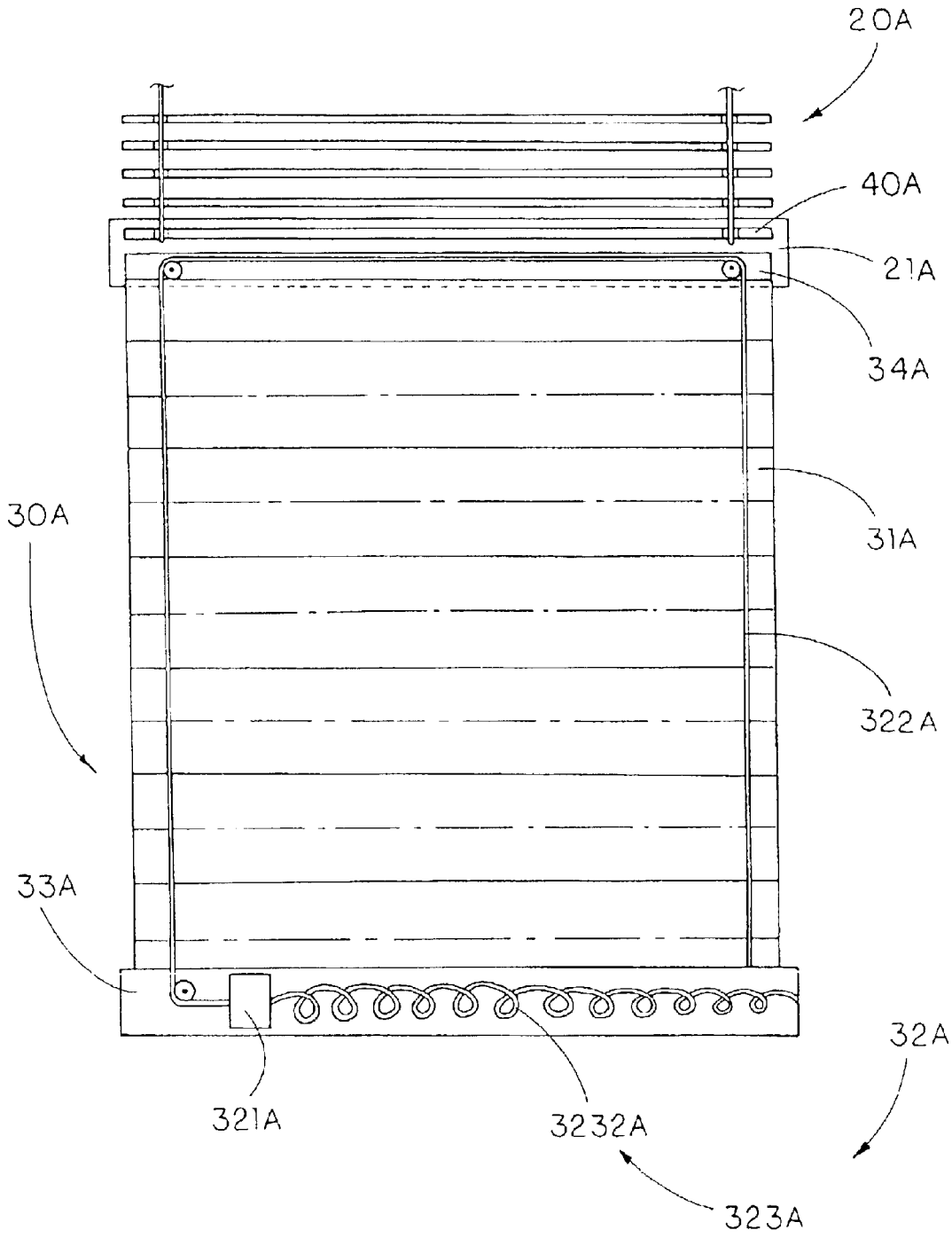
FIG. 11 is a partially sectional view of the multi-functional shading device according to the above fourth preferred embodiment of the present invention.

As shown in FIG. 11, the second operating means 32A comprises a lift locker 321A slidably mounted on the base stabilizer 33A, a lift cord 322A having a first end affixed to the base stabilizer 33A and a second end affixed to the lift locker 321A wherein the lift cord 322A is penetrating through two side portions of the translucent fabric 32A and extending along the upper supporter 34A, and a lift retaining device 323A for applying an urging force to the lift locker 321A so as to retain the lift locker 321A on the base stabilizer 33A in position. In which, the lift locker 321A is arranged to slide towards to the first end of the lift cord 322A to lift up the base stabilizer 33A so as to fold up the second shading arrangement 30A and is arranged to slide away from the first end of the lift cord 322A to drop down the base stabilizer to unfold the second shading arrangement 30A.

The lift retaining device 323A comprises a compression spring 3232A mounted in the base stabilizer 33A and is provided a side end of the base stabilizer 33A and the lift locker 321A. The compression spring 3232A has one end affixed to the side end of the base stabilizer 33A and another end affixed to the lift locker 321A. Accordingly, the compression spring 3232A will normally urge and retain the lift locker 321A towards to the first end of the lift cord 322A so as to fold up the second shading arrangement 30A.

Figure 12:
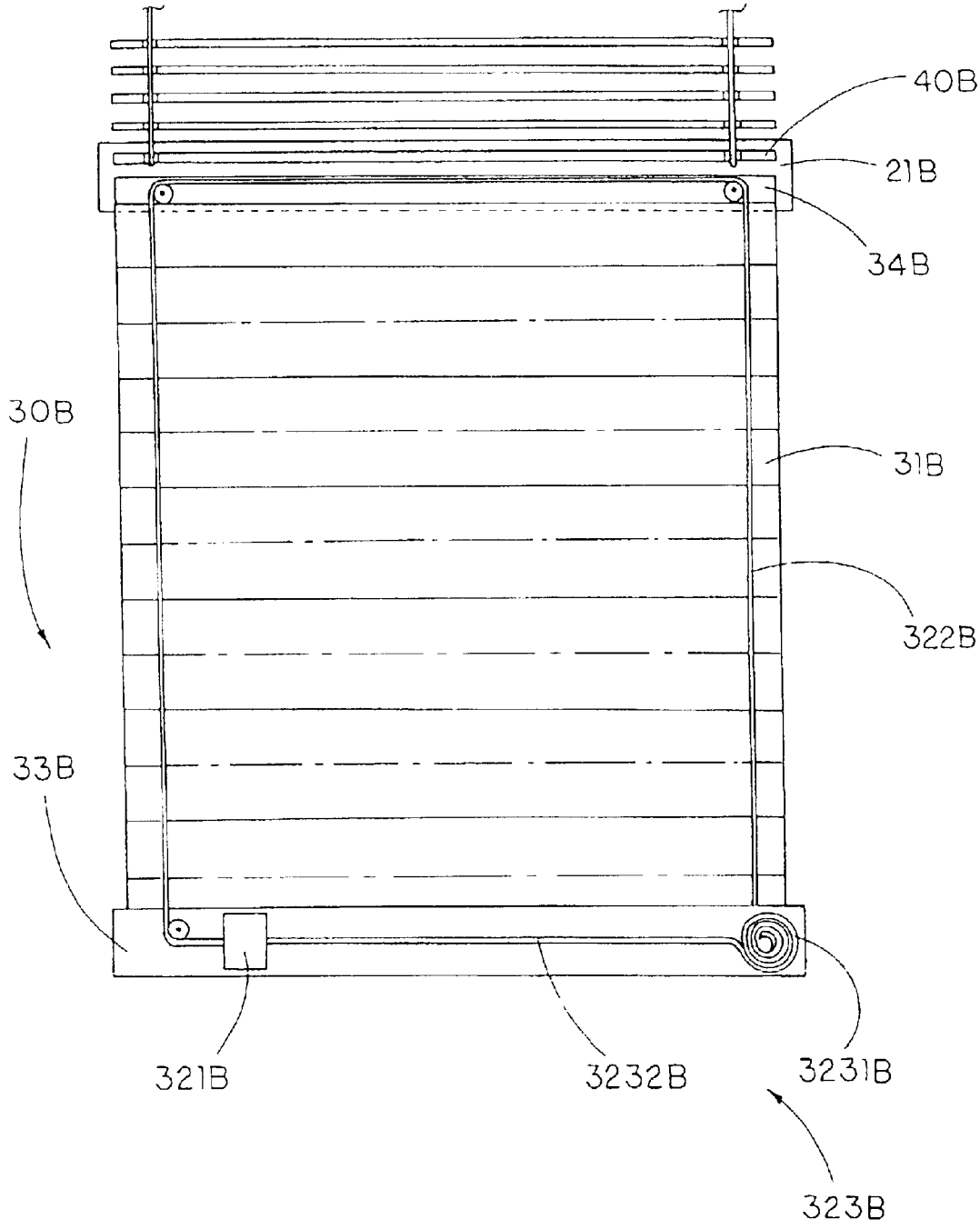
FIG. 12 illustrates an alternative mode of a lift retaining device of the multi-functional shading according to the fifth preferred embodiment of the present invention.

FIG. 12 illustrates an alternative mode of the lift retaining device 323B which comprises an auto-pulley system 3231B provided in the side end of the base stabilizer 33B wherein the auto-pulley system 3231B having an extending cable 3232B extending therefrom in an auto receiving manner is affixed to the lift locker 321B for applying the urging force to the lift locker 321B, so as to retain the second shading arrangement 30B in the folded position.

Figure 13:
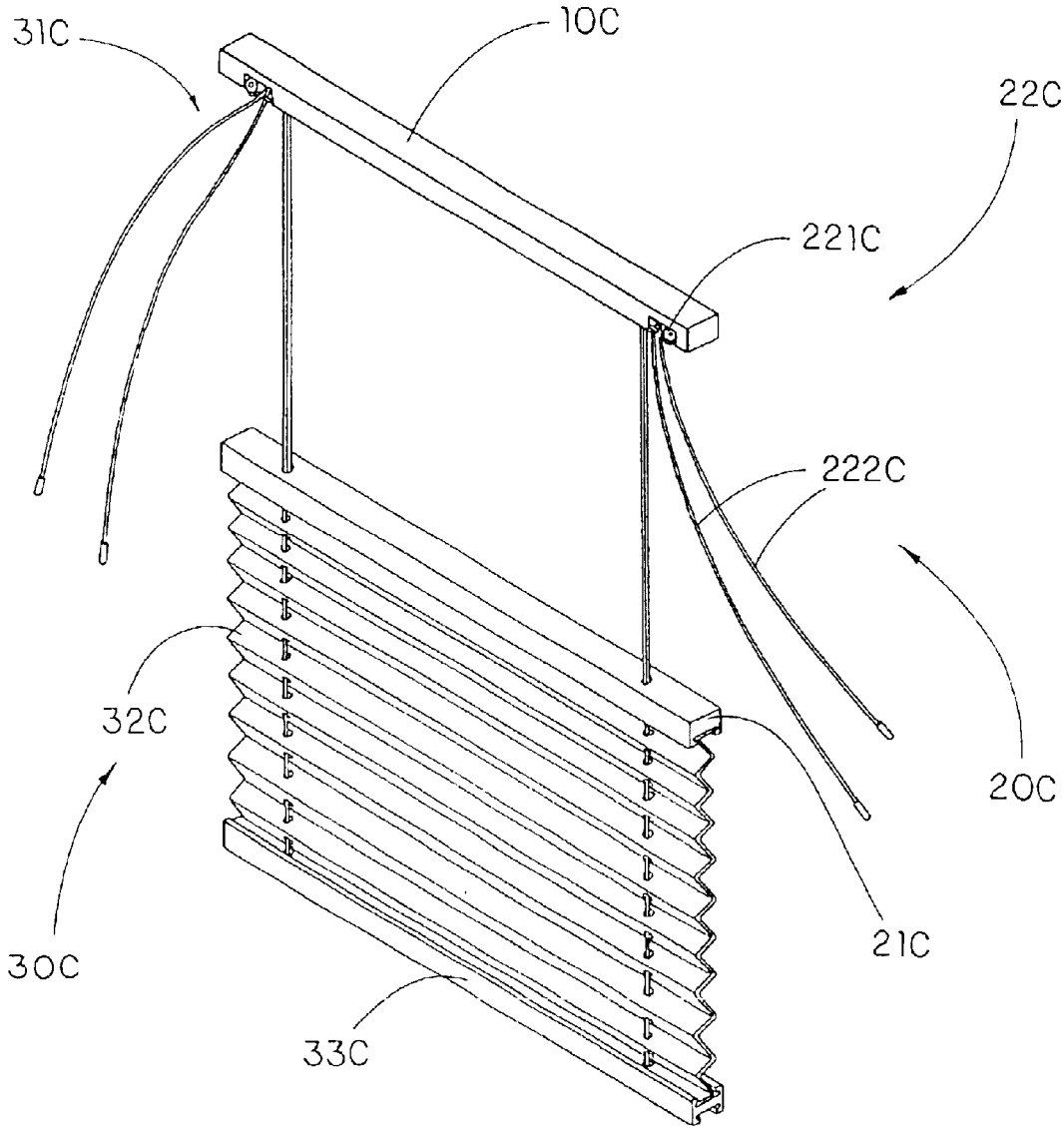
FIG. 13 is a perspective view of a multi-functional shading device according to a fifth preferred embodiment of the present invention.

Referring to FIG. 13, a multi-functional shading device according to a fifth embodiment of the present invention is illustrated, which basically is an alternative mode of the above first embodiment of the present invention. The first shading arrangement 20C comprises a base member 21C downwardly extended form the top traverse supporter 10C and a first operating means 22C for selectively lifting up the base member 21C towards the traverse supporter 10C and unlifting the base member 21C to drop downwardly away from the traverse supporter 10C.

The first operating means 22C comprises a first lift lock 221C rotatably mounted on the traverse supporter 10C and a pair of lift cords 222C each having a first end portion extended to the bottom member 21C. Each of the two lift cords 222C upwardly extends to penetrate through the slats 23 and then traversely extends through the traverse supporter 10C, wherein a second end portion of each of the lift cords 222C is extended out of the traverse supporter 10C via the first lift lock 221C to control the folding and unfolding of the first shading arrangement 20C. In other words, the first shading arrangement 20C is a slat type curtain without a plurality of slats mounted between the traverse supporter 10C and the base member 21C so as to let the light directly passing through the first shading arrangement 20C.

The second shading arrangement 30C as mentioned in the first embodiment, which is downwardly extended from the base member 21C of the first shading arrangement 20C, comprises a base stabilizer 33C, a translucent fabric 32C extended between the base member 21C of the first shading arrangement 20C and the base stabilizer 33C, and a second operating means 31C for lifting up and dropping down the base stabilizer 33C to fold up and unfold the second shading arrangement 30C respectively.

Figure 14:
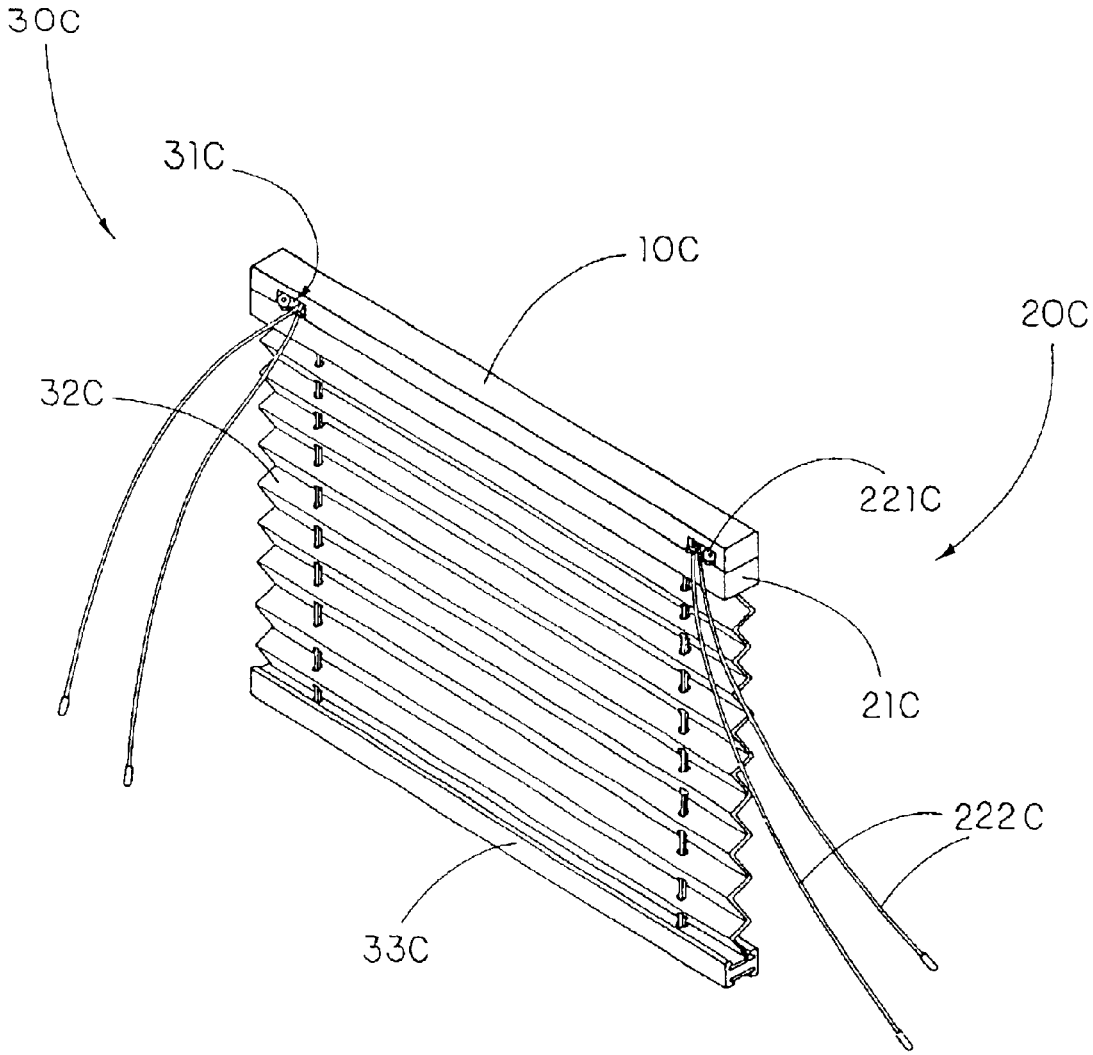
FIG. 14 illustrates an operation of the multi-functional shading device according to the above fifth preferred embodiment of the present invention.

According to the fifth embodiment, the light can be directly pass through the first shading arrangement 20C of the multi-functional shading device and is partially blocked by the second shading arrangement 30C so that while using the multi-functional shading device, a room will obtain an adequate light intensity from the first shading arrangement 20C and people inside the room will not be irritated by the directed light since the light is blocked by the second shading arrangement 30C. Thus, the multi-functional shading device is adapted for selectively folding and unfolding the first and second shading arrangement 20C, 30C to adjustably block the light, as shown in FIG. 14.

Figure 15:
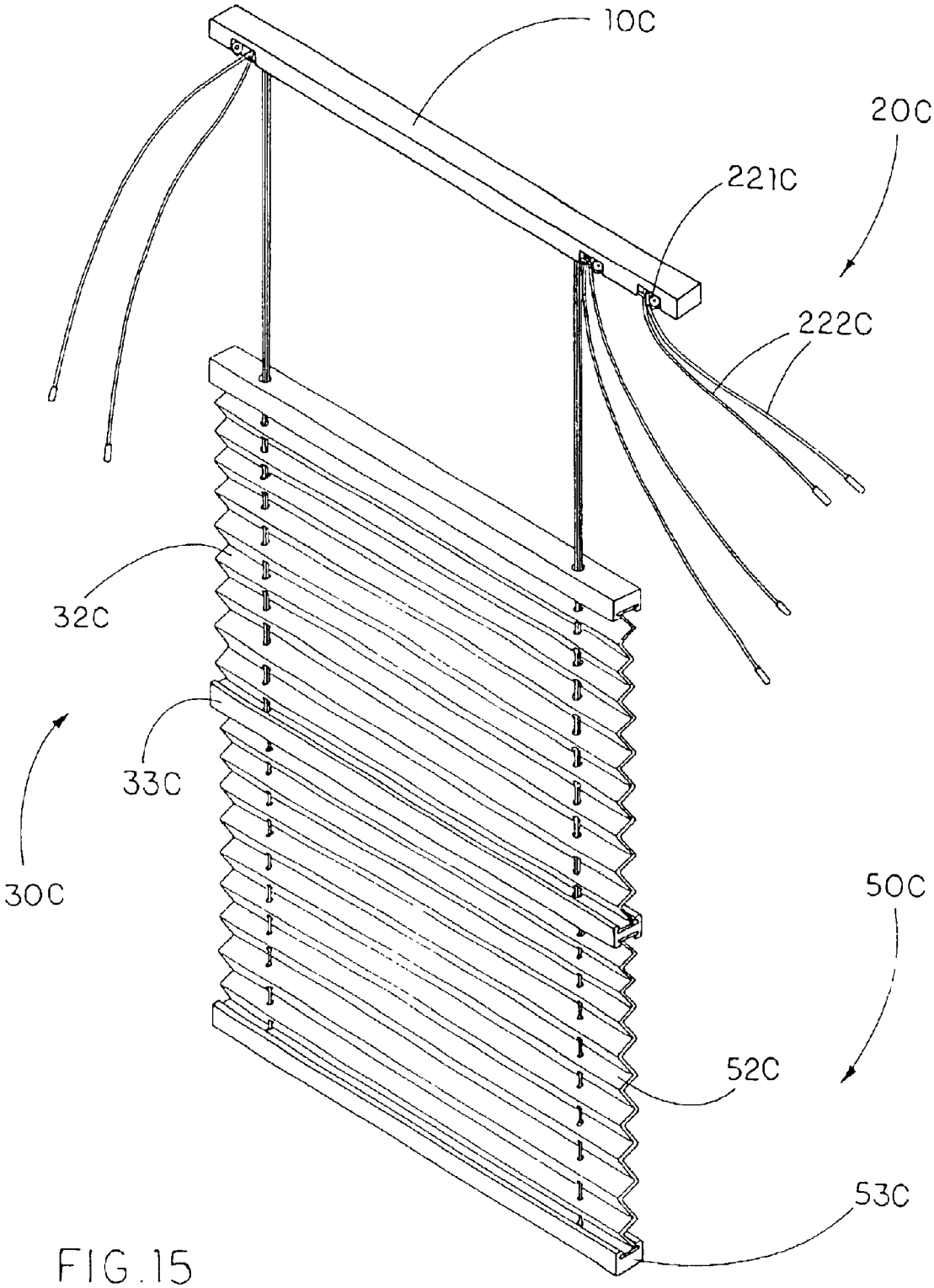
FIG. 15 illustrates an alternative mode of the multi-functional shading device according to the above fifth preferred embodiment of the present invention.

It is worth to mention that a third shading arrangement 50C as mentioned in the second embodiment is adapted for mounting on the second shading arrangement 30C for selectively blocking the light intensity wherein the third shading arrangement 50C comprises a supplementary translucent fabric 52C having different light blocking ability of the translucent fabric 32C of the second shading arrangement 30C for selectively blocking different intensities of light, as shown in FIG. 15.

While the foregoing description and drawings describe the preferred embodiments of the present invention, it should be appreciated that certain obvious modifications, variations, and substitutions may be made without departing from the spirit and scope of the present invention. For example, the first shading arrangement can be the drapery type curtain and the second shading arrangement can be the slat type curtain in order to selectively block the intensity of light by the upper section (the first shading arrangement) and the lower section (the second shading arrangement) of the multi-functional shading device. Also, an artistic painting can be printed on the translucent fabric so as to provide an aesthetically light effect when the light passes through the translucent fabric.

What is claimed is:

1. A multi-functional shading device, comprising:

a top traverse supporter adapted for affixing to a top beam of a window;

a first shading arrangement downwardly extended from said top traverse supporter comprising a base member and a first operating means for selectively lifting up said base member towards said traverse supporter and unlifting said base member to drop downwardly away from said traverse supporter, wherein said first operating means comprises a first lift lock rotatably mounted on said traverse supporter and a pair of lift cords each having a first end portion extended to said bottom bar, each of said two lift cords being upwardly extended to penetrate through said first shading arrangement and then traversely extends through said traverse supporter, wherein a second end portion of each of said lift cords is extended out of said traverse supporter via said first lift lock to control said folding and unfolding of said first shading arrangement;

a second shading arrangement comprising an upper supporter, a base stabilizer, a translucent fabric, which is folded in a Z-shaped manner, downwardly extended from said base member to said base stabilizer, and a second operating means for folding and unfolding said translucent fabric, wherein said first and second shading arrangements having different light intensity blocking abilities are adapted for selectively blocking lights passing through from one side to another side of said shading arrangements respectively, wherein said second operating means comprises a lift locker slidably mounted on said base stabilizer, a lift cord having a first end affixed to said base stabilizer and a second end affixed to said lift locker wherein said lift cord penetrates through two side portions of said translucent fabric and extends along said upper supporter, and a lift retaining device applying an urging force to said lift locker so as to retain said lift locker on said base stabilizer in position; and a H-shaped connecting member having a top mounting slot and a bottom mounting slot wherein said base member of said first shading arrangement is slidably inserted into said top mounting slot and said upper supporter of said second shading arrangement is slidably inserted into said bottom mounting slot so as to securely connect said second shading arrangement to said first shading arrangement.

2. A multi-functional shading device, as recited in claim 1, wherein said lift locker is arranged to slide towards to said first end of said lift cord to lift up said base stabilizer so as to fold up said second shading arrangement and is arranged to slide away from said first end of said lift cord to drop down said base stabilizer to unfold said second shading arrangement.

3. A multi-functional shading device, as recited in claim 2, wherein said lift retaining device comprises a compression spring mounted in said base stabilizer, wherein said compression spring has one end affixed to a side end of said base stabilizer and another end affixed to said lift locker, wherein said compression spring normally urges and retains said lift locker towards to said first end of said lift cord so as to fold up said second shading arrangement.

4. A multi-functional shading device, as recited in claim 2, wherein said lift retaining device comprises an auto-pulley system provided in a side end of said base stabilizer wherein said auto-pulley system, which has an extending cable extending therefrom, is affixed to said lift locker for applying a urging force to said lift locker so as to retain said second shading arrangement in said folded position.

5. A multi-functional shading device, comprising:

a top traverse supporter adapted for affixing to a top beam of a ceiling;

a first shading arrangement downwardly extended from said top traverse supporter comprising a base member and a first operating means for selectively lifting up said base member towards said traverse supporter and unlifting said base member to drop downwardly away from said traverse supporter, wherein said first operating means comprises a first lift lock rotatably mounted on said traverse supporter and a pair of lift cords each having a first end portion extended to said bottom bar, each of said two lift cords being upwardly extended to penetrate through said first shading arrangement and then traversely extends through said traverse supporter, wherein a second end portion of each of said lift cords is extended out of said traverse supporter via said first lift lock to control said folding and unfolding of said first shading arrangement;

a second shading arrangement comprising an upper supporter, a base stabilizer, a translucent fabric, which is folded in a Z-shaped manner, downwardly extended from said base member to said base stabilizer, and a second operating means for folding and unfolding said translucent fabric, wherein said first and second shading arrangements having different light intensity blocking abilities are adapted for selectively blocking lights passing through from one side to another side of said shading arrangements respectively, wherein said second operating means comprises a lift locker slidably mounted on said base stabilizer, a lift cord having a first end affixed to said base stabilizer and a second end affixed to said lift locker wherein said lift cord penetrates through two side portions of said translucent fabric and extends along said upper supporter, and a lift retaining device applying an urging force to said lift locker so as to retain said lift locker on said base stabilizer in position; and a H-shaped connecting member having a top mounting slot and a bottom mounting slot wherein said base member of said first shading arrangement is slidably inserted into said top mounting slot and said upper supporter of said second shading arrangement is slidably inserted into said bottom mounting slot so as to securely connect said second shading arrangement to said first shading arrangement, wherein said top mounting slot is a U-shaped mounting slot securely receiving said base member of said first shading arrangement, and said bottom mounting slot is also a U-shaped mounting slot securely receiving said upper supporter of said second shading arrangement, so as to securely connect said translucent fabric between said base member and said base stabilizer.

6. A multi-functional shading device, as recited in claim 5, wherein said lift locker is arranged to slide towards to said first end of said lift cord to lift up said base stabilizer so as to fold up said second shading arrangement and is arranged to slide away from said first end of said lift cord to drop down said base stabilizer to unfold said second shading arrangement.

7. A multi-functional shading device, as recited in claim 6, wherein said lift retaining device comprises a compression spring mounted in said base stabilizer, wherein said compression spring has one end affixed to a side end of said base stabilizer and another end affixed to said lift locker, wherein said compression spring normally urges and retains said lift locker towards to said first end of said lift cord so as to fold up said second shading arrangement.

8. A multi-functional shading device, as recited in claim 6, wherein said lift retaining device comprises an auto-pulley system provided in a side end at said base stabilizer wherein said auto-pulley system, which has an extending cable extending therefrom, is affixed to said lift locker for applying a urging force to said lift locker so as to retain said second shading arrangement in said folded position.

9. A multi-functional shading device, comprising:

a top traverse supporter adapted for affixing to a top beam of a ceiling;

a first shading arrangement downwardly extended from said top traverse supporter comprising a base member and a first operating means for selectively lifting up said base member towards said traverse supporter and unlifting said base member to drop downwardly away from said traverse supporter, wherein said first operating means comprises a first lift lock rotatably mounted on said traverse supporter and a pair of lift cords each having a first end portion extended to said bottom bar, each of said two lift cords being upwardly extended to penetrate through said first shading arrangement and then traversely extends through said traverse supporter, wherein a second end portion of each of said lift cords is extended out of said traverse supporter via said first lift lock to control said folding and unfolding of said first shading arrangement; and a second shading arrangement comprising a base stabilizer, a translucent fabric, which is folded in a Z-shaped manner, downwardly extended from said base member to said base stabilizer, and a second operating means for folding and unfolding said translucent fabric, wherein said first and second shading arrangements having different light intensity blocking abilities are adapted for selectively blocking lights passing through from one side to another side of said shading arrangements respectively, wherein said second operating means comprises a lift locker slidably mounted on said base stabilizer, a lift cord having a first end affixed to said base stabilizer and a second end affixed to said lift locker wherein said lift cord penetrates through two side portions of said translucent fabric and extends along said upper supporter, and a lift retaining device applying an urging force to said lift locker so as to retain said lift locker on said base stabilizer in position.

10. A multi-functional shading device, as recited in claim 9, wherein said lift locker is arranged to slide towards to said first end of said lift cord to lift up said base stabilizer so as to fold up said second shading arrangement and is arranged to slide away from said first end of said lift cord to drop down said base stabilizer to untold said second shading arrangement.

11. A multi-functional shading device, as recited in claim 10, wherein said lift retaining device comprises a compression spring mounted in said base stabilizer, wherein said compression spring has one end affixed to a side end of said base stabilizer and another end affixed to said lift locker, wherein said compression spring normally urges and retains said lift locker towards to said first end of said lift cord so as to fold up said second shading arrangement.

12. A multi-functional shading device, as recited in claim 10, wherein said lift retaining device comprises an auto-pulley system provided in a side end of said base stabilizer wherein said auto-pulley system, which has an extending cable extending therefrom, is affixed to said lift locker for applying a urging force to said lift locker so as to retain said second shading arrangement in said folded position.

* * * * *